US011993350B2

(12) United States Patent
McBride

(10) Patent No.: US 11,993,350 B2
(45) Date of Patent: May 28, 2024

(54) SWIM UP BAR FOR A BOAT

(71) Applicant: Margaritaville Enterprises, LLC, Palm Beach, FL (US)

(72) Inventor: Eric McBride, Manchester Center, VT (US)

(73) Assignee: MARGARITAVILLE ENTERPRISES, LLC, Palm Beach, FL (US)

( * ) Notice: Subject to any disclaimer, the term of this patent is extended or adjusted under 35 U.S.C. 154(b) by 210 days.

(21) Appl. No.: 17/556,581

(22) Filed: Dec. 20, 2021

(65) Prior Publication Data

US 2023/0192244 A1 Jun. 22, 2023

(51) Int. Cl.
*B63B 29/00* (2006.01)
*B63B 1/10* (2006.01)

(52) U.S. Cl.
CPC ..... *B63B 29/00* (2013.01); *B63B 1/10* (2013.01)

(58) Field of Classification Search
CPC ..... B63B 1/10; B63B 1/121; B63B 29/00; B63B 34/00; B63B 2029/022; B63B 2029/043; B63B 2221/24
USPC ..... 114/343, 362, 363
See application file for complete search history.

(56) References Cited

U.S. PATENT DOCUMENTS

| | | | | |
|---|---|---|---|---|
| 4,146,941 | A * | 4/1979 | Haslam | E06C 1/381 182/91 |
| 9,067,647 | B2 * | 6/2015 | Neese | B63B 27/14 |
| 9,540,077 | B2 * | 1/2017 | Fuller, IV | E06C 9/08 |
| 10,538,289 | B1 * | 1/2020 | Cifers | B63B 17/00 |
| 11,319,028 | B2 * | 5/2022 | Jones, III | B63B 21/04 |

* cited by examiner

*Primary Examiner* — Daniel V Venne
(74) *Attorney, Agent, or Firm* — Greenberg Traurig, LLP

(57) ABSTRACT

A system includes a housing and a swim up bar configured to be mounted on a boat. The swim up bar is movable into or out from the housing. In a deployed position, the swim up bar is extended from a bow of the boat. In a storage position, the swim up bar is contained within the housing.

18 Claims, 10 Drawing Sheets

SWIM UP BAR FOR A BOAT

FIELD

This disclosure relates generally to boats. More specifically, this disclosure relates to a stowable swim up bar for a boat.

BACKGROUND

Boats are well known for use in fishing, skiing, and other water activities, as well as simple leisurely travel on waterways. One popular type of boat is a pontoon or a tritoon.

SUMMARY

In one embodiment, a system includes a housing and a swim up bar configured to be mounted on a boat. In one embodiment, the swim up bar is movable into or out from the housing. In one embodiment, in a deployed position, the swim up bar is extended from a bow of the boat. In one embodiment, in a storage position, the swim up bar is contained within the housing.

In one embodiment, the system includes a second housing and a second swim up bar configured to be mounted on the boat. In one embodiment, the second swim up bar is movable into or out from the second housing. In one embodiment, in a deployed position, the second swim up bar is extended from a bow of the boat. In one embodiment, in a storage position, the second swim up bar is contained within the second housing.

In one embodiment, the swim up bar includes a table and a seat and the second swim up bar includes a second table and a second seat.

In one embodiment, the table and the second table are surfboard shaped.

In one embodiment, the table and the second table are shark-fin shaped.

In one embodiment, the swim up bar is rotatable about a pivot head from the deployed position into the storage position.

In one embodiment, the system includes a plurality of motors, wherein the swim up bar is deployed by the plurality of motors.

In one embodiment, the system includes a safety catch configured to prevent unintended deployment or retraction of the swim up bar.

In one embodiment, the system includes a switch, wherein the switch is in an open state in the deployed position and the switch is in a closed state in the storage position.

In one embodiment, the switch is a magnetic switch and the swim up bar includes a magnet.

In one embodiment, a system includes a boat; a housing disposed under a deck of the boat; and a swim up bar. In one embodiment, the swim up bar is movable into or out from the housing. In one embodiment, in a deployed position, the swim up bar is extended from a bow of the boat. In one embodiment, in a storage position, the swim up bar is contained within the housing. In one embodiment, the swim up bar includes a plurality of tables, and a plurality of seats.

In one embodiment, the plurality of tables are surfboard shaped.

In one embodiment, the plurality of tables are shark-fin shaped.

In one embodiment, the swim up bar is rotatable about a pivot head from the deployed position into the storage position.

In one embodiment, the system includes a plurality of motors, wherein the swim up bar is deployed by the plurality of motors.

In one embodiment, the system includes a safety catch configured to prevent unintended deployment or retraction of the swim up bar.

In one embodiment, the system includes a switch, wherein the switch is in an open state in the deployed position and the switch is in a closed state in the storage position.

In one embodiment, the switch is a magnetic switch and the swim up bar includes a magnet.

In one embodiment, the boat is a pontoon boat.

In one embodiment, a system includes a pontoon boat; a housing disposed under a deck of the pontoon boat; and a swim up bar. In one embodiment, the swim up bar is movable into or out from the housing. In one embodiment, in a deployed position, the swim up bar is extended from a bow of the boat. In one embodiment, in a storage position, the swim up bar is contained within the housing. In one embodiment, the swim up bar includes a plurality of tables, and a plurality of seats. In one embodiment, the system includes a magnetic switch. In one embodiment, in the deployed position, the switch is in an open state. In one embodiment, in the storage position, the switch is in a closed state. In one embodiment, the magnetic switch is in electric communication with an ignition of the boat. In one embodiment, the ignition is inoperable when the switch is in the open state.

BRIEF DESCRIPTION OF THE DRAWINGS

Reference is made to the drawings that form a part of this disclosure, and which illustrate embodiments in which the devices and methods described herein can be practiced.

Like reference numbers represent the same or similar parts throughout.

DETAILED DESCRIPTION

Figure 1:
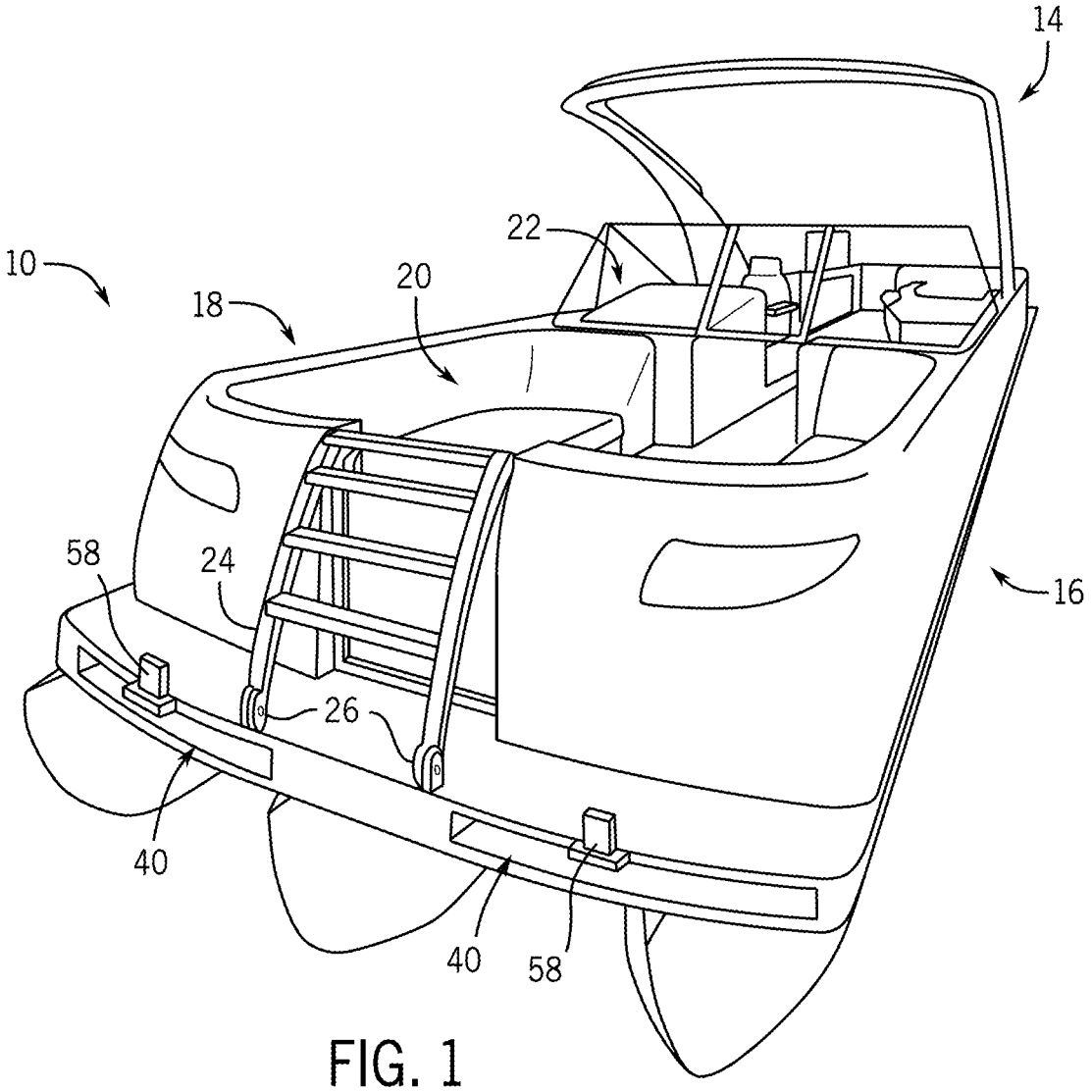
FIG. 1 is a schematic diagram of a perspective view of a boat, according to some embodiments.

FIG. 1 is a schematic diagram of a perspective view of a boat 10, according to one embodiment. The boat 10 in the illustrated embodiment is a type of pontoon boat (e.g., using floats or tubes for floatation). The boat 10 in the illustrated embodiment is a tritoon boat (e.g., having three floats or tubes). It is to be appreciated that the tritoon boat is an example and that other numbers of floats or tubes (e.g., two tubes) are possible. The embodiments described herein may be applied to a boat other than a pontoon boat.

The boat 10 includes a bow 12, a stern 14, a port side 16, and a starboard side 18. There are additional features within the boat 10 that are not critical to the aspects of this disclosure. For example, the boat 10 includes seating 20, a driver's console 22, and one or more engines (not shown) such as one or more outboard engines or the like.

Figure 2:
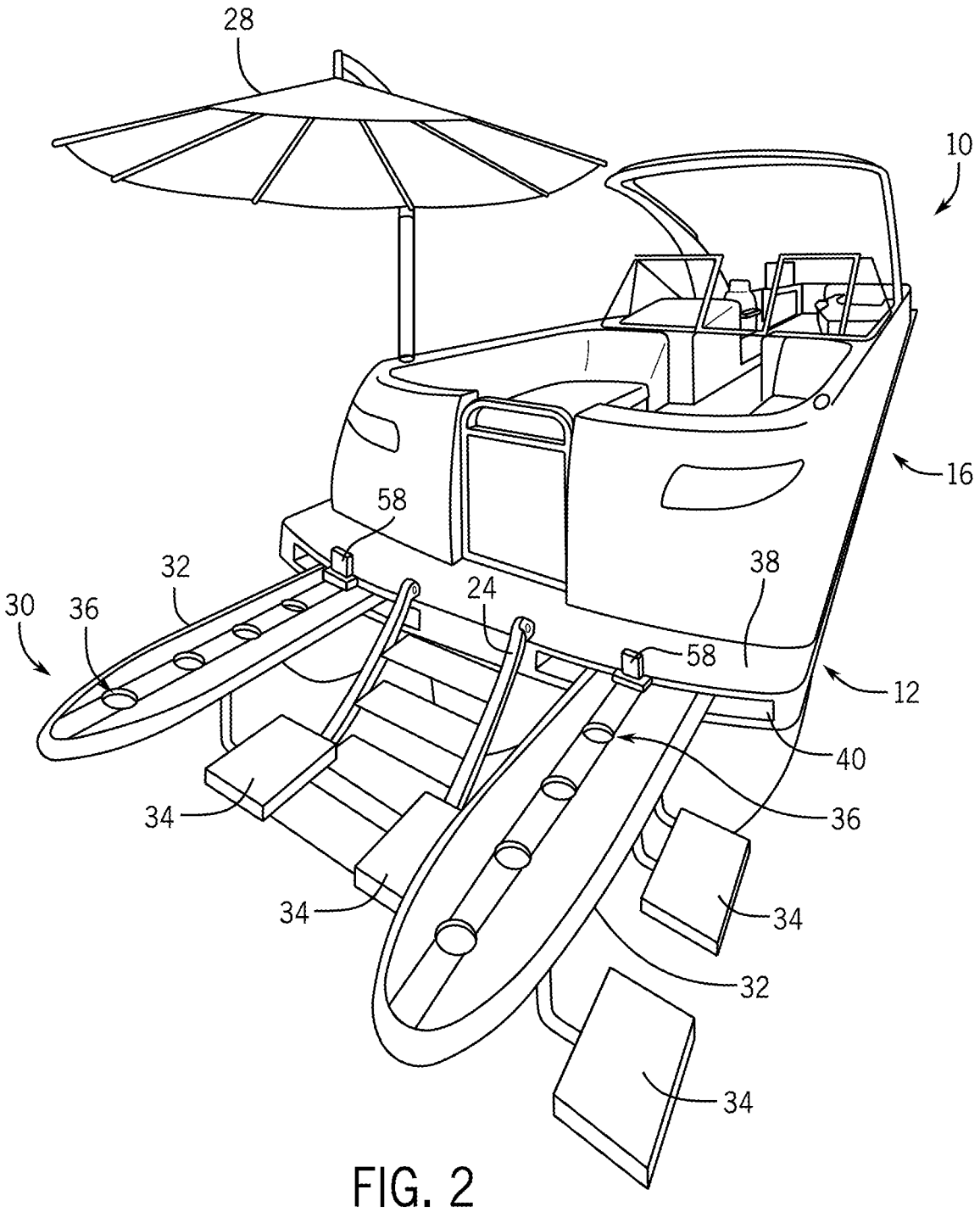
FIG. 2 shows the boat of FIG. 1 with a swim up bar deployed from the bow, according to one embodiment.

The bow 12 of the boat 10 includes a ladder 24. In one embodiment, the ladder 24 is stowable. For example, in the illustrated embodiment, the ladder 24 can include a plurality of rotatable hinges 26 about which the ladder 24 can be rotated into a storage position (as shown in FIG. 1) or a deployed position (as shown in FIG. 2). In one embodiment, the ladder 24 may not be included on the bow 12 of the boat 10. In one embodiment, the ladder 24 may lock into the storage position or the deployed position. In one embodiment, the boat 10 can include a cleat to tie the ladder 24 into the storage position. In such an embodiment, the rope can be untied from the cleat to lower the ladder into the deployed position. In one embodiment, the cleat can be in a form of a ring or can be in a form of a boat cleat.

FIG. 2 shows the boat 10 with a swim up bar 30 deployed from the bow 12, according to one embodiment. The swim up bar 30 is present on the boat 10 in FIG. 1, but is in the retracted or storage position. In the retracted or storage position, the swim up bar 30 is stowed within a deck of the boat 10.

The boat 10 includes an umbrella 28. The umbrella 28 is illustrated on the starboard side 18 of the boat 10. An umbrella can additionally, or alternatively, be placed on the port side 16 of the boat 10, according to one embodiment.

The swim up bar 30 includes a plurality of tables 32 and a plurality of seats 34.

In the illustrated embodiment, each of the plurality of tables 32 is shaped to look like a surfboard. It is to be appreciated that the shape of the plurality of tables 32 can vary beyond a surfboard shape. For example, the embodiment shown and described in accordance with FIGS. 6-12B below includes different shapes. In the illustrated embodiment, the plurality of tables 32 include a plurality of apertures 36. The plurality of apertures 36 can be sized to function as a cupholder. In one embodiment, the plurality of apertures 36 can alternatively be a recess or cutout into the plurality of tables 32, but not extending therethrough. In such an embodiment, the cutouts can generally serve as a cupholder.

In the illustrated embodiment the plurality of seats 34 includes six total seats, three for each of the plurality of tables 32. It is to be appreciated that the number of seats is an example and that fewer (e.g., one seat for each table) or additional (e.g., more than three seats per table) are possible. As shown in the illustrated embodiment, between the plurality of tables 32 there may be fewer seats because of the location of the ladder 24. It is to be appreciated that if the ladder 24 was not included, the plurality of tables 32 could include more seats between the plurality of tables 32. In one embodiment, there may be no seats between the plurality of tables 32.

The swim up bar 30 extends from a housing 40 formed underneath deck 38 of the boat 10.

Figure 3:
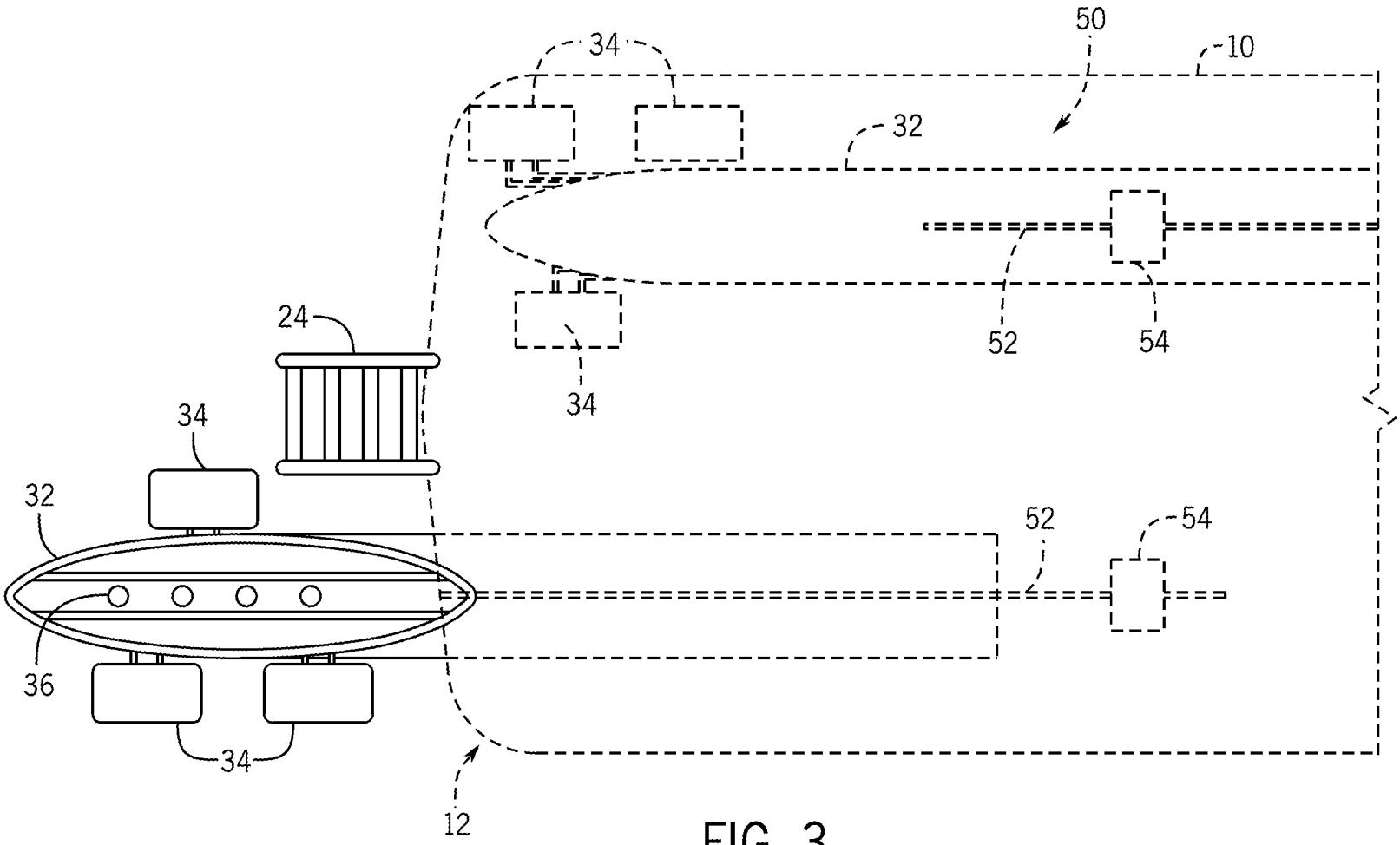
FIG. 3 shows a deployment or retraction system for the swim up bar of FIG. 2, according to one embodiment.

FIG. 3 shows a deployment or retraction system 50 for the swim up bar 30, according to one embodiment. In the illustrated embodiment, one of the plurality of tables 32 is in the storage position and the other of the plurality of tables 32 is in the deployed position. It is to be appreciated that this is for the purposes of this description. In one embodiment, the plurality of tables 32 can be separately deployable. In another embodiment, the plurality of tables 32 can be deployable concurrently.

The deployment or retraction system 50 generally includes a plurality of racks 52 and a plurality of motors 54. In the illustrated embodiment, the plurality of motors 54 includes two motors. It is to be appreciated that the number of motors can vary beyond two. In one embodiment, a single motor may be configured to drive the plurality of racks 52. The plurality of motors 54 can be located under the seating 20 in the boat 10. In one embodiment, the plurality of motors 54 can be located under a deck of the boat 10, so long as the plurality of motors 54 are maintained in a location in which they are prevented from being contacted by water. In one embodiment, the plurality of motors 54 can be electrically connected with a power source and a switch for controlling the plurality of motors 54. In one embodiment, the switch can be located on the driver's console 22 (FIG. 1). In one embodiment, the switch can be located on the bow 12. In one embodiment, the switch can include a plurality of switches and a first of the plurality of switches can be located on the driver's console 22 (FIG. 1) and a second of the plurality of switches can be located on the bow 12.

Figure 4A:
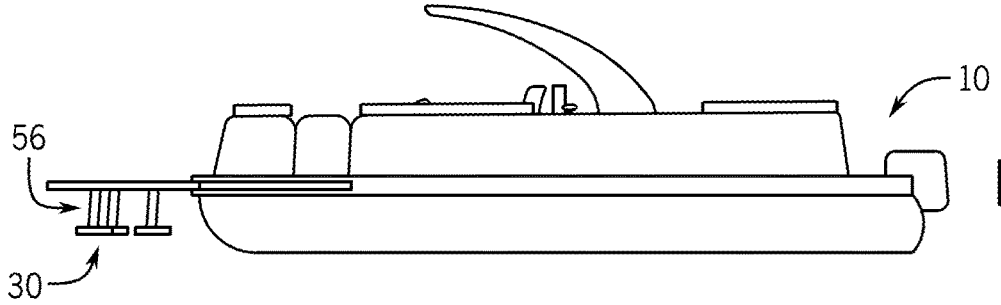
FIGS. 4A-4E show a process in which the swim up bar of FIG. 2 is moved from the deployed position to the retracted or storage position, according to one embodiment.
Figure 4B:
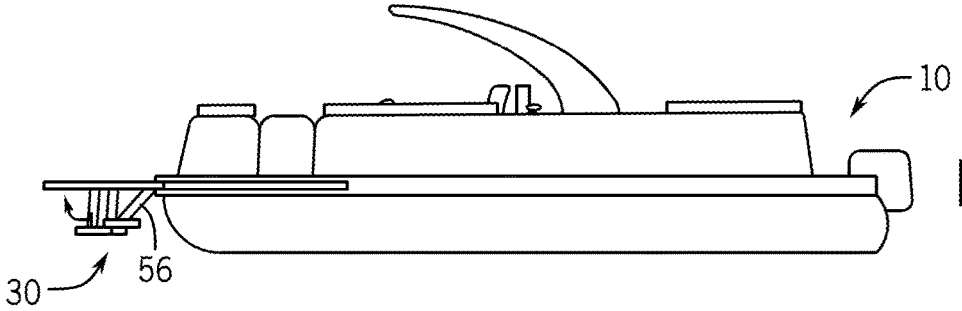
Figure 4C:
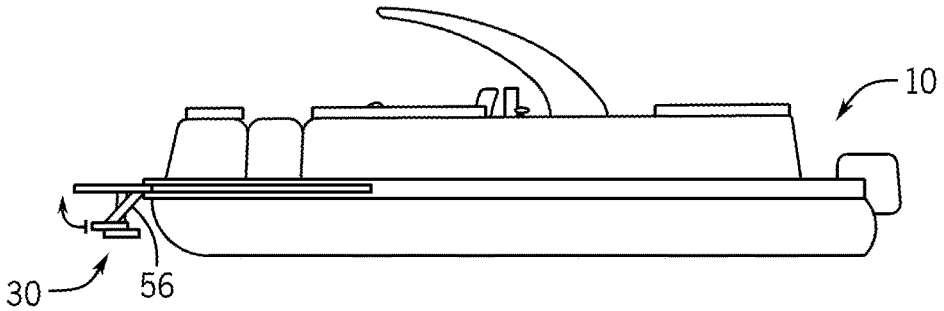
Figure 4D:
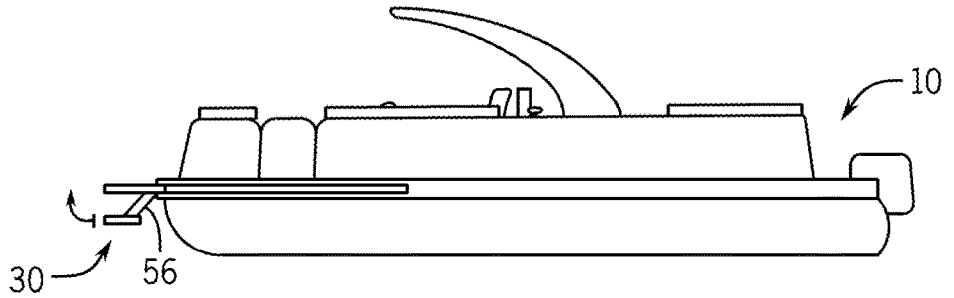
Figure 4E:
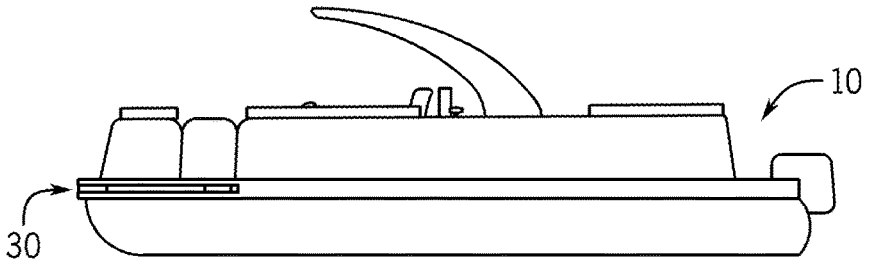

FIGS. 4A-4E show a process in which the swim up bar 30 is moved from the deployed position to the retracted or storage position, according to one embodiment. In FIG. 4A, the swim up bar 30 is in a fully deployed position. To transition from the fully deployed position of FIG. 4A, a switch (e.g., in the driver's console 22 of FIG. 1) can be used to drive the motor to retract the plurality of racks 52 (FIG. 3) to which the plurality of tables 32 are secured. As a result, the swim up bar 30 moves toward the stern 14 of the boat 10. When the seat brackets 56 of the swim up bar 30 reach the bow 12 of the boat (FIG. 4B), the seat brackets 56 rotate toward the plurality of tables 32 about their mounting brackets. As the swim up bar 30 continues inward (FIGS. 4C-4D), the plurality of seats 34 continue to rotate until the seat tops are parallel with the table bottom. FIG. 4E shows the swim up bar 30 within the housing 40 (FIG. 2) under the deck 38 (FIG. 2) of the boat 10.

Figure 5A:
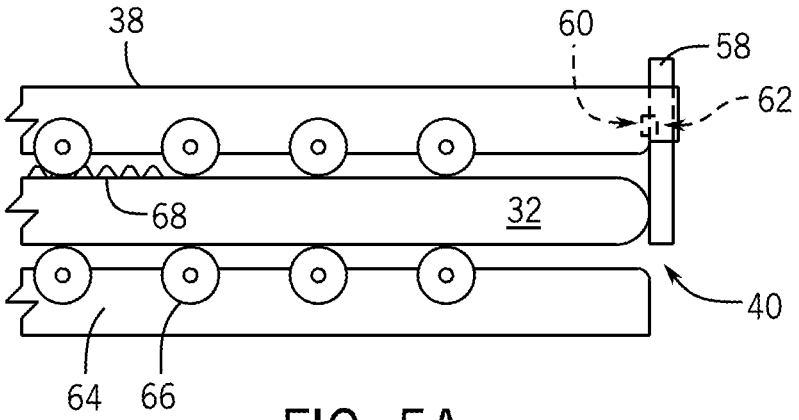
FIGS. 5A-5C show the deployment or retraction system of FIG. 3 for the swim up bar of FIG. 2, according to one embodiment.
Figure 5B:
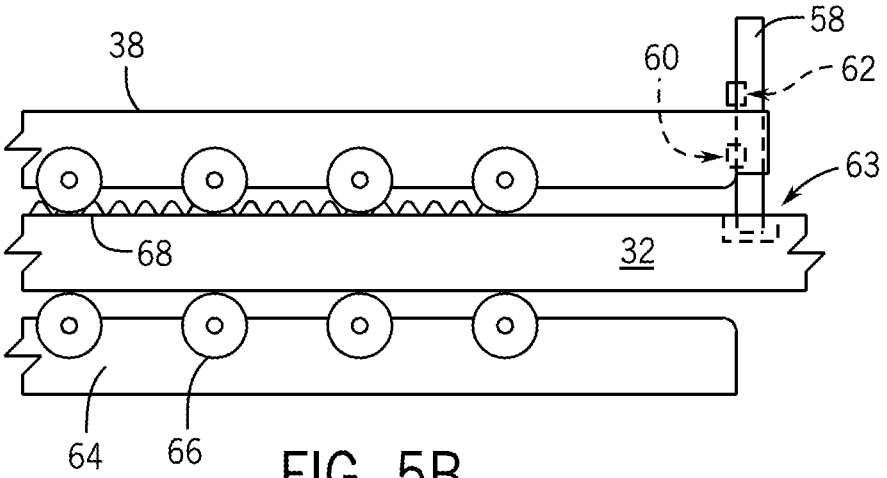
Figure 5C:
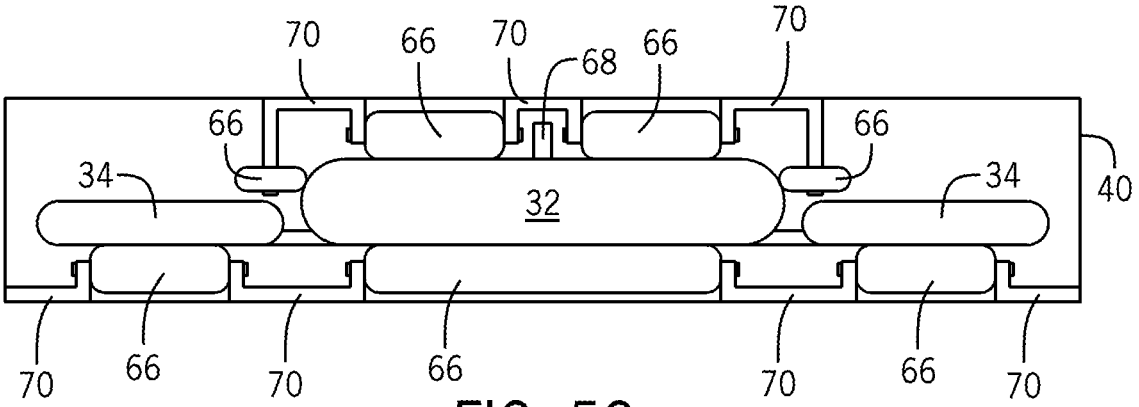

FIGS. 5A-5C show the deployment or retraction system 50 for the swim up bar 30, according to one embodiment.

In FIG. 5A, the swim up bar 30 is in the storage position. A safety catch 58 extends across a tip 72 of the table 32. The safety catch 58 can prevent the table 32 from being accidentally deployed. For example, if an operator of the boat 10 inadvertently activates the motor 54, the safety catch 58 will prevent the table 32 from being deployed from the housing 40. The safety catch 58 also includes a switch 60. In one embodiment, the switch 60 can be a magnetic switch. In such an embodiment, a magnet 62 can be embedded into the safety catch 58 so that, when in the storage position, as in FIG. 5A, the switch 60 is closed. The switch 60 can be electrically connected to the ignition of the boat 10 so that, when the switch 60 is closed, the ignition circuit is closed and the boat engine is operable.

The deployment or retraction system 50 includes a plurality of wheels 66 mounted to the deck 38 and a lower housing 64. The plurality of wheels aid in the movement of the swim up bar 30 from the deployed position to the storage position. Additionally, when in the storage position, the wheels can help maintain a location of the table 32 so that it stays in place despite jostling from movement of the boat 10. The deployment or retraction system 50 includes a rack 68 configured to be driven by the motor 54 (FIG. 3). The rack 68 is disposed on an upper surface of the table 32 in the illustrated embodiment. It is to be appreciated that the rack 68 can alternatively be placed on a lower surface of the table. The rack 68 is disposed at a location on the table 32 that does not extend beyond the bow 12 of the boat when deployed.

In FIG. 5B, the safety catch 58 is moved to a deployed position in which the safety catch 58 is within a groove 63 and prevents the table 32 from retracting or being extended any further. In the deployed position, the switch 60 is opened because the magnet 62 is moved away from the switch 60. As a result, the ignition circuit of the boat 10 is open, and thus, the boat engine is not operable. The switch 60 can increase an overall safety as the boat cannot be operated when the swim up bar 30 is deployed from the bow 12 of the boat 10.

FIG. 5C shows a front view of the deployment or retraction system 50 within the housing 40. As shown, there are a plurality of wheels 66 disposed on a lower side of the table 32, on a lower side of the plurality of seats 34, on a side of the table 32, and a top surface of the table 32. As discussed above, this arrangement can prevent the table from shifting due to movement of the boat 10. This can help ensure that the rack 68 stays aligned with the motor 54 (FIG. 3). In one embodiment, the plurality of wheels 66 can be connected to the housing 40 via a member 70. In one embodiment, the plurality of wheels 66 can be polyurethane or the like.

Figure 6:
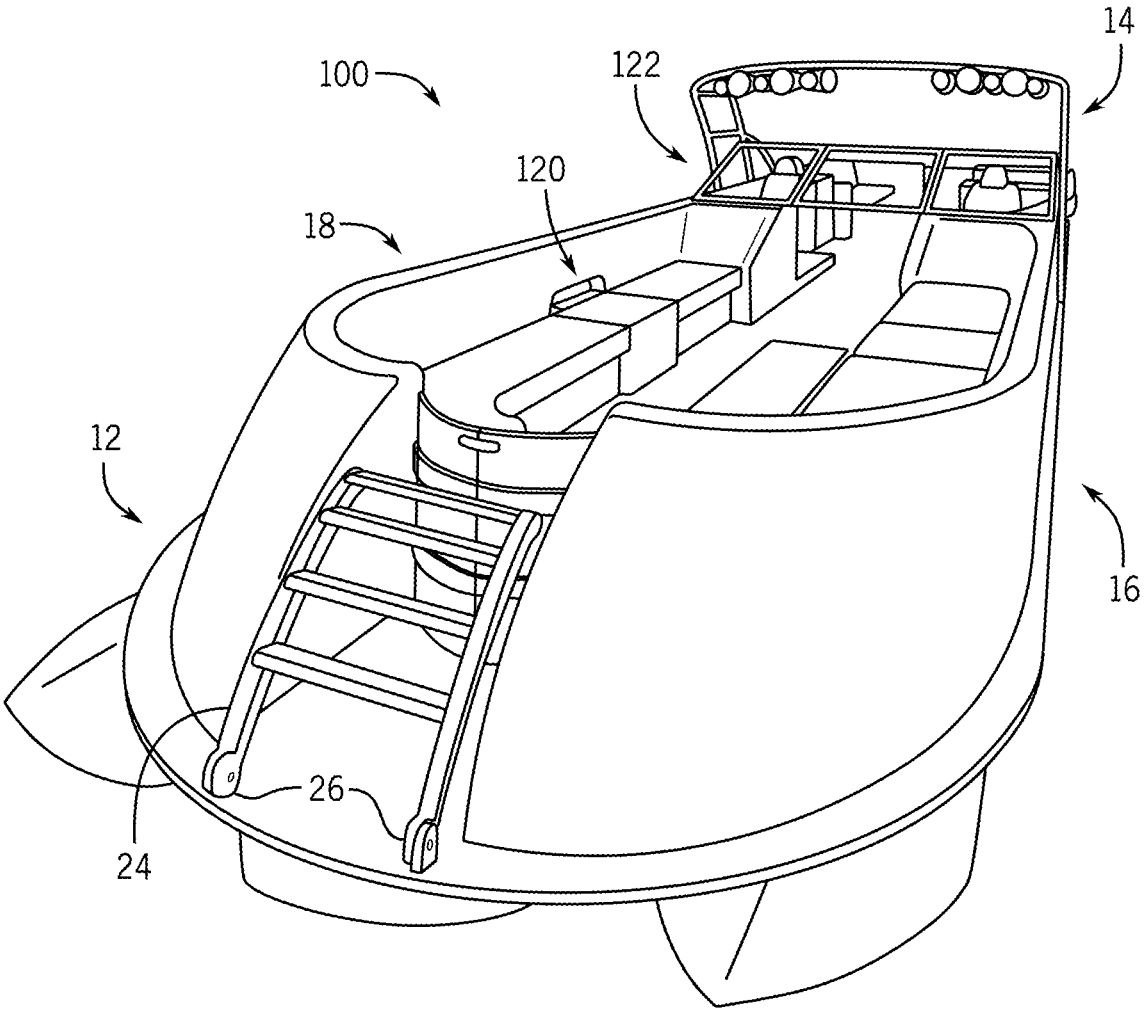
FIG. 6 is a schematic diagram of a perspective view of a boat, according to some embodiments.

FIG. 6 is a schematic diagram of a perspective view of a boat 100, according to one embodiment. The boat 100 in the illustrated embodiment is a type of pontoon boat (e.g., using floats or tubes for floatation). The boat 100 in the illustrated embodiment is a tritoon boat (e.g., having three floats or tubes). It is to be appreciated that the tritoon boat is an example and that other numbers of floats or tubes (e.g., two tubes) are possible. The embodiments described herein may be applied to a boat other than a pontoon boat.

The boat 100 includes a bow 12, a stern 14, a port side 16, and a starboard side 18. There are additional features within the boat 100 that are not critical to the aspects of this disclosure. For example, the boat 100 includes seating 120, a driver's console 122, and one or more engines (not shown) such as one or more outboard engines or the like.

Figure 7:
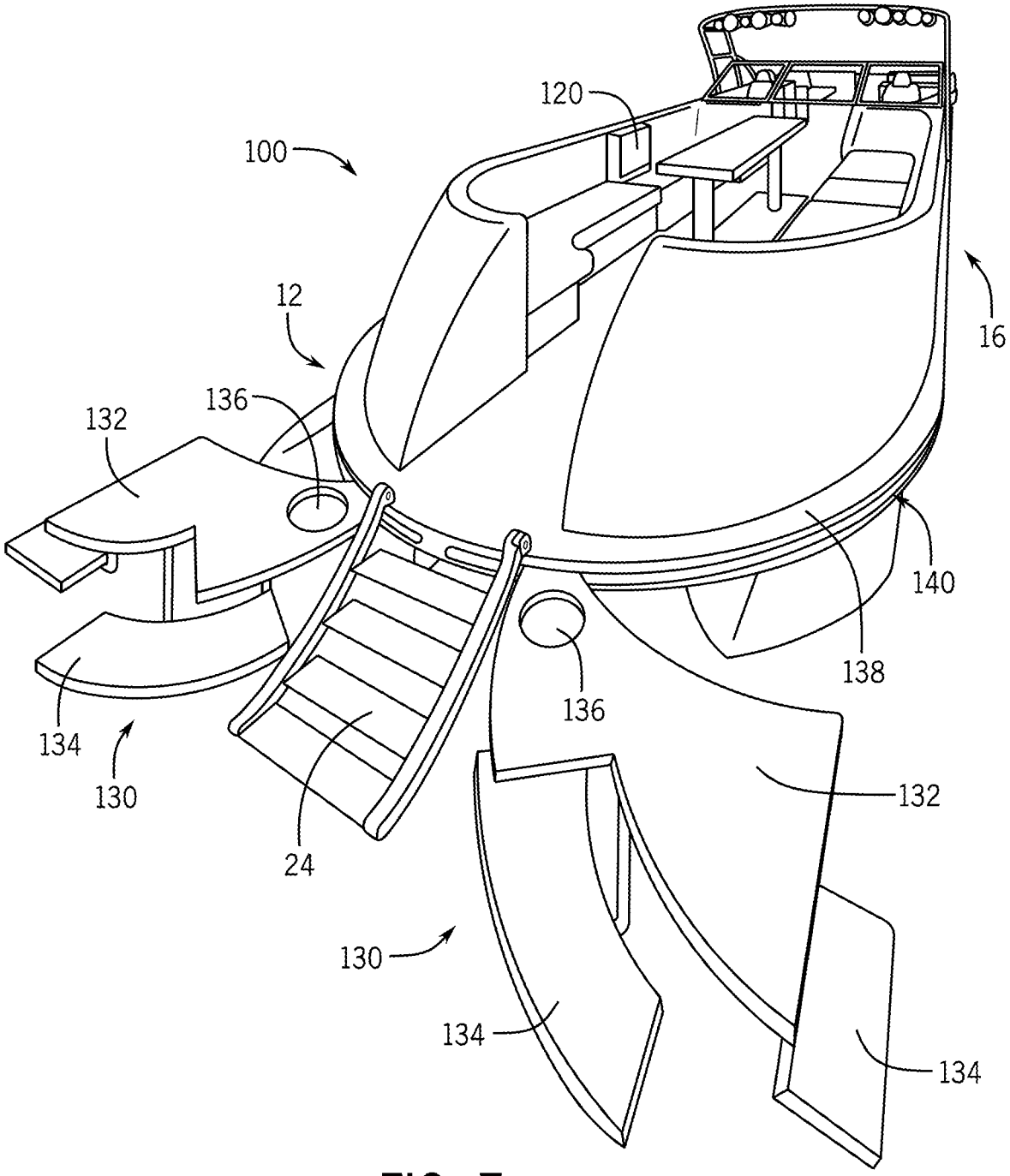
FIG. 7 shows the boat of FIG. 6 with a swim up bar deployed from the bow, according to one embodiment.

The bow 12 of the boat 100 includes a ladder 24. In one embodiment, the ladder 24 is stowable. For example, in the illustrated embodiment, the ladder 24 can include a plurality of rotatable hinges 26 about which the ladder 24 can be rotated into a storage position (as shown in FIG. 6) or a deployed position (as shown in FIG. 7). In one embodiment, the ladder 24 may not be included on the bow 12 of the boat 100. In one embodiment, the ladder 24 may lock into the storage position or the deployed position. For example, in one embodiment, the rotatable hinges 26 can include a locking pin to selectively prevent rotation of the rotatable hinges 26. In one embodiment, the boat 100 can include a cleat to tie the ladder 24 into the storage position. In such an embodiment, the rope can be untied from the cleat to lower the ladder into the deployed position. In one embodiment, the cleat can be in a form of a ring or can be in a form of a boat cleat. In one embodiment, the bow 12 of the boat 100 can include decorative doors that are designed to have the appearance of, for example, a keg barrel. The boat 100 can include one or more additional features such as, for example, a popup table or the like.

FIG. 7 shows the boat 100 with a swim up bar 130 deployed from the bow 12, according to one embodiment. The swim up bar 130 is present on the boat 100 in FIG. 6, but is in the retracted or storage position. In the retracted or storage position, the swim up bar 130 is stowed within a deck of the boat 100.

The swim up bar 130 includes a plurality of tables 132 and a plurality of seats 134.

In the illustrated embodiment, each of the plurality of tables 132 is shaped to look like a shark fin. It is to be appreciated that the shape of the plurality of tables 132 can vary beyond a fin shape. In the illustrated embodiment, the plurality of tables 132 include an of aperture 136. The apertures 136 can be sized to function as a cupholder, ice bucket holder, or the like. In one embodiment, the apertures 136 can alternatively be a recess or cutout into the plurality of tables 132, but not extending therethrough. In such an embodiment, the cutouts can generally serve as a cupholder.

In the illustrated embodiment the plurality of seats 134 includes four total seats, two for each of the plurality of tables 132. It is to be appreciated that the number of seats is an example and that fewer (e.g., one seat for each table) or additional (e.g., more than two seats per table) are possible.

The swim up bar 130 extends from a housing 140 formed underneath deck 138 of the boat 100.

Figure 8:
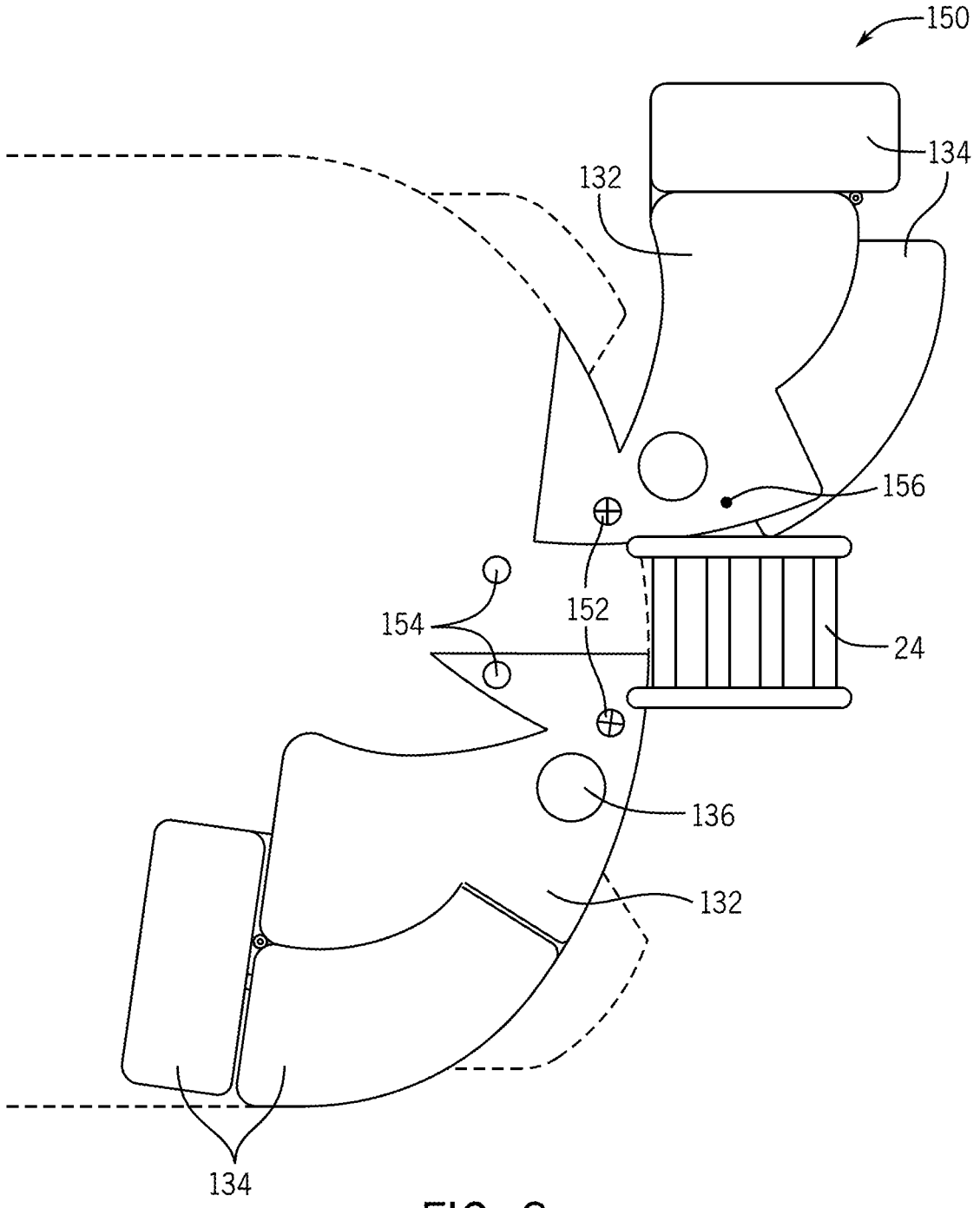
FIG. 8 shows a deployment or retraction system for the swim up bar of FIG. 7, according to one embodiment.

FIG. 8 shows a deployment or retraction system 150 for the swim up bar 130, according to one embodiment. In the illustrated embodiment, one of the plurality of tables 132 is in the storage position and the other of the plurality of tables 132 is in the deployed position. In one embodiment, the plurality of tables 132 may be deployed at a same time. In one embodiment, the plurality of tables 132 may be separately deployable.

The swim up bar 130 is rotatable about a pivot head 152 to transition between the storage position and the deployed position. In one embodiment, the pivot head 152 can include a motor so that the rotation of the swim up bar 130 can be controlled via a switch. In one embodiment, the swim up bar 130 may be manually rotatable about the pivot head 152 (e.g., in case of a power failure or the like). In one embodiment, the pivot head 152 can include a rotation limiter so that the table 132 is rotatable to a particular location. In one embodiment, an amount of rotation about the pivot head 152 from the storage position to the deployed position can be 90° to 100°. The deployment or retraction system 150 can include a switch 154 in the housing 140. In one embodiment, the switch can be a magnetic switch. In such an embodiment, a magnet 156 embedded into the table 132. In the deployed position, the switch 154 is opened because the magnet 156 is moved away from the switch 154. As a result, the ignition circuit of the boat 100 is open, and thus, the boat engine is not operable. The switch 154 can increase an overall safety as the boat cannot be operated when the swim up bar 130 is deployed from the bow 12 of the boat 100.

When in the storage position, the switch 154 is closed. The switch 154 can be electrically connected to the ignition of the boat 100 so that, when the switch 154 is closed, the ignition circuit is closed and the boat engine is operable.

Figure 9A:
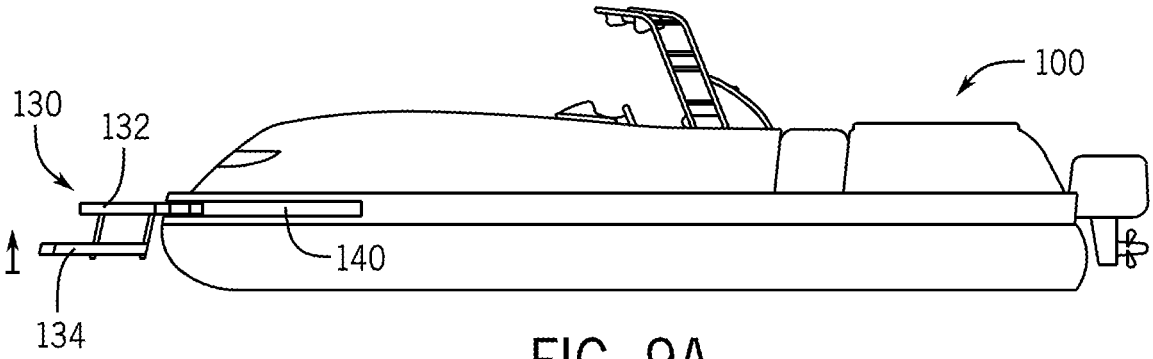
FIGS. 9A-9C show a process in which the swim up bar of FIG. 7 is moved from the deployed position to the retracted or storage position, according to one embodiment.
Figure 9B:
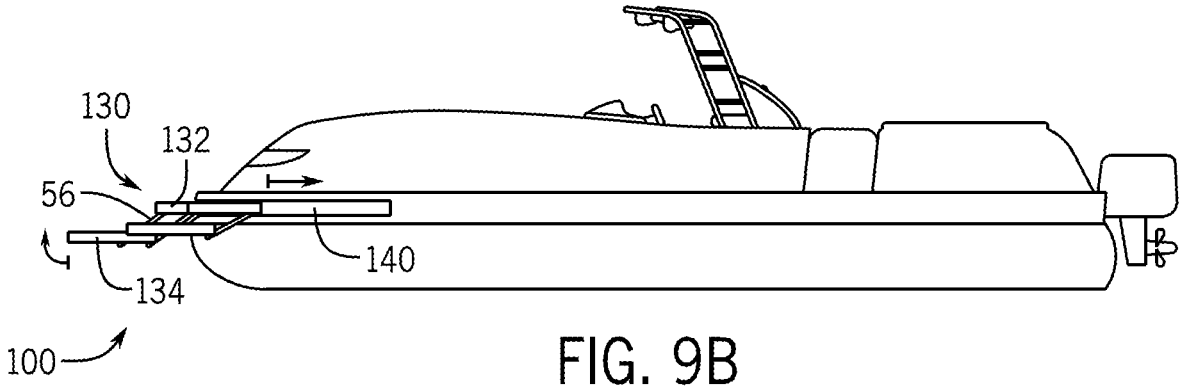
Figure 9C:
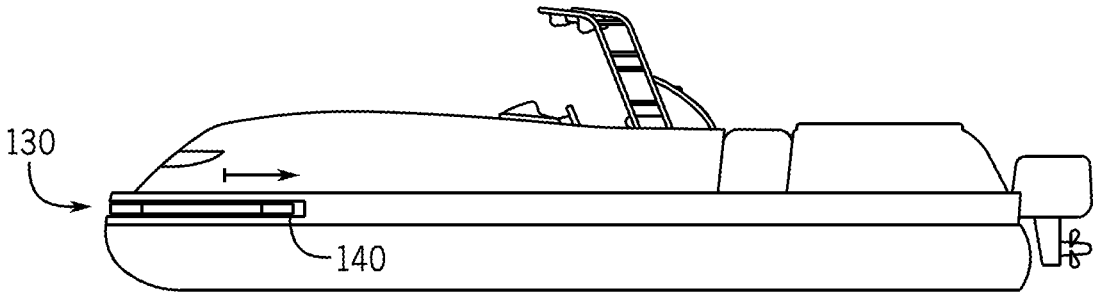

FIGS. 9A-9C show a process in which the swim up bar 130 is moved from the deployed position to the retracted or storage position, according to one embodiment. In FIG. 9A, the swim up bar 130 is in a fully deployed position. To transition from the fully deployed position of FIG. 9A, the tables 132 can be rotated toward the boat 100. As a result, the swim up bar 130 moves toward the bow 12 of the boat 100. When the seat brackets 56 of the swim up bar 130 reach the bow 12 of the boat (FIG. 9B), the seat brackets 160 rotate toward the plurality of tables 132 about their mounting brackets. As the swim up bar 130 continues inward, the plurality of seats 134 continue to rotate until the seat tops are parallel with the table bottom. FIG. 9C shows the swim up bar 130 within the housing 140 (FIG. 7) under the deck 138 (FIG. 7) of the boat 100.

Figure 10A:
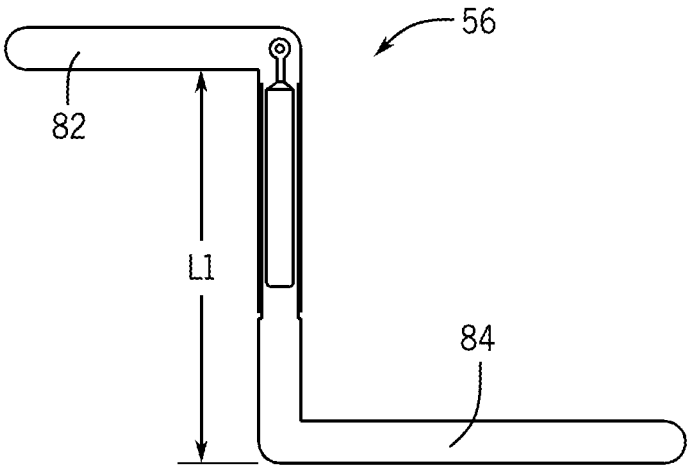
FIGS. 10A-10B show a bracket, according to one embodiment.
Figure 10B:
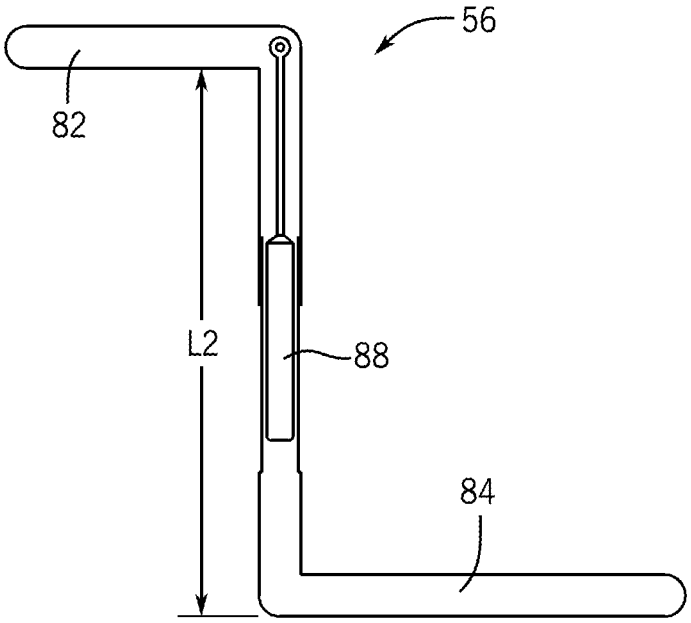

FIGS. 10A-10B show a bracket 56 for connecting the plurality of seats 34 to each of the plurality of tables 32 or for connecting the plurality of seats 134 to the plurality of tables 132, according to one embodiment. The bracket 80 includes a first member 82 connected with a second member 84. The first member 82 can be secured to an underside of the table 32 or the table 132. In one embodiment, the first member 82 and the second member 84 are each L-shaped. In one embodiment, the bracket 56 includes a hydraulic ram 88 that can be used to provide a variable length of the bracket 56, depending upon whether weight is applied to the seat 34 or the seat 134. For example, in FIG. 10A, the bracket 56 is unweighted. In FIG. 10A, a distance between the first member 82 and the second member 84 is L1. In FIG. 10B, the bracket 56 is weighted (e.g., a person is sitting on the seat 34 or the seat 134). In FIG. 10B, the first member 82 and the second member 84 are spaced by a distance L2, which is greater than the distance L1. In one embodiment, the bracket 56 can enable a compact vertical distance of the seat 34 or the seat 134 when not in use, or extension when used. This can, for example, make for a more compact seat 34 or seat 134 for purposes of folding into the deployed configuration.

The terminology used herein is intended to describe embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

It is to be understood that changes may be made in detail, especially in matters of the construction materials employed and the shape, size, and arrangement of parts without departing from the scope of the present disclosure. This Specification and the embodiments described are examples, with the true scope and spirit of the disclosure being indicated by the claims that follow.

The invention claimed is:

1. A swim up bar, comprising:
a housing;
the swim up bar configured to be mounted on a boat;
wherein the swim up bar is movable into or out from the housing,
in a deployed position, the swim up bar is extended from a bow of the boat, and
in a storage position, the swim up bar is contained within the housing;
a second housing; and
a second swim up bar configured to be mounted on the boat;
wherein the second swim up bar is movable into or out from the second housing,
in a deployed position, the second swim up bar is extended from a bow of the boat, and
in a storage position, the second swim up bar is contained within the second housing;
wherein the swim up bar includes a table and a seat and the second swim up bar includes a second table and a second seat.

2. The swim up bar of claim 1, wherein the table and the second table are surfboard shaped.

3. The swim up bar of claim 1, wherein the table and the second table are shark-fin shaped.

4. The swim up bar of claim 1, wherein the swim up bar is rotatable about a pivot head from the deployed position into the storage position.

5. The swim up bar of claim 1, comprising a plurality of motors, wherein the swim up bar is deployed by the plurality of motors.

6. The swim up bar of claim 1, comprising a safety catch configured to prevent unintended deployment or retraction of the swim up bar.

7. The swim up bar of claim 1, comprising a switch, wherein the switch is in an open state in the deployed position and the switch is in a closed state in the storage position.

8. The swim up bar of claim 7, wherein the switch is a magnetic switch and the swim up bar includes a magnet.

9. A boat, comprising:
a housing disposed under a deck of the boat;
a swim up bar,
wherein the swim up bar is movable into or out from the housing,
in a deployed position, the swim up bar is extended from a bow of the boat,
in a storage position, the swim up bar is contained within the housing, and
wherein the swim up bar includes:
a plurality of tables, and
a plurality of seats.

10. The boat of claim 9, wherein the plurality of tables are surfboard shaped.

11. The boat of claim 9, wherein the plurality of tables are shark-fin shaped.

12. The boat of claim 9, wherein the swim up bar is rotatable about a pivot head from the deployed position into the storage position.

13. The boat of claim 9, comprising a plurality of motors, wherein the swim up bar is deployed by the plurality of motors.

14. The boat of claim 9, comprising a safety catch configured to prevent unintended deployment or retraction of the swim up bar.

15. The boat of claim 9, comprising a switch, wherein the switch is in an open state in the deployed position and the switch is in a closed state in the storage position.

16. The boat of claim 15, wherein the switch is a magnetic switch and the swim up bar includes a magnet.

17. The boat of claim 9, wherein the boat is a pontoon or a tritoon boat.

18. A pontoon boat, comprising:
a plurality of housings disposed under a deck of the pontoon boat;
a plurality of swim up bars,
wherein each of the plurality of swim up bars is movable into or out from the respective housing,
in a deployed position, each of the plurality of swim up bars is extended from a bow of the boat,
in a storage position, each of the plurality of swim up bars is contained within the respective housing, and
wherein each of the plurality of swim up bars includes:
a table, and
a plurality of seats; and
a magnetic switch,
wherein in the deployed position, the switch is in an open state,
wherein in the storage position, the switch is in a closed state, wherein the magnetic switch is in electric communication with an ignition of the boat, and wherein the ignition is inoperable when the switch is in the open state.

* * * * *